United States Patent [19]

Lischick

[11] 4,363,159

[45] Dec. 14, 1982

[54] SEPARABLE FASTENING DEVICE

[76] Inventor: K. Edward Lischick, 306 White Ave., Northvale, N.J. 07647

[21] Appl. No.: 153,017

[22] Filed: May 27, 1980

[51] Int. Cl.[3] ..... A44B 17/00

[52] U.S. Cl. ..... 24/201 HH; 24/201 R

[58] Field of Search ..... 24/201 A, 201 HE, 201 R, 24/230.5, 231, 237; 273/15 C, 158

[56] References Cited

U.S. PATENT DOCUMENTS

| | | | |
|---|---|---|---|
| 5,740 | 1/1874 | Lamb | 24/201 R X |
| 367,969 | 8/1887 | Gawn | 24/231 |
| 477,154 | 6/1892 | Quein | 24/201 R X |
| 1,016,260 | 2/1912 | Fuchs | 24/201 R |
| 3,153,829 | 10/1964 | Luketa | 24/201 R |
| 3,280,438 | 10/1966 | Luketa | 24/201 R |
| 3,289,262 | 12/1966 | Allen | 24/201 R |

FOREIGN PATENT DOCUMENTS

| | | | |
|---|---|---|---|
| 915352 | 7/1946 | France | 24/201 R |
| 970540 | 6/1950 | France | 24/201 HH |

*Primary Examiner*—Roy D. Frazier
*Assistant Examiner*—Peter A. Aschenbrenner
*Attorney, Agent, or Firm*—Ronald G. Goebel

[57] ABSTRACT

A separable fastening device is provided comprising a pair of clasping members, each of said members being comprised of a rigid, bendable material having a central aperture extending therethrough and at least one substantially flat edge section, each flat edge section having;

(a) an internal angular notch;

(b) an external angular notch; and (c) a slot in said edge section connecting with the vertexes of said internal and external angular notches and dividing said edge section into split end portions, said slot having a gap less than the thickness of the edge section of the other of said pair of clasping members.

5 Claims, 4 Drawing Figures

SEPARABLE FASTENING DEVICE

BACKGROUND OF THE INVENTION

Clasping devices currently available for the purpose of fastening and unfastening articles to which they are attached such as clothing all have major deficiencies of one form or another. Those clasps that are an item separate from the articles to be fastened such as pins, clamps, rings, nets suffer from the inconvenience of having a logistics independent from and in addition to the logistics of the articles themselves. Those clasps that are integral with the paired articles such as buttons, snaps, hooks have a variety of other short-comings. Some are difficult to install and maintain. Others lack a uniformity in their locking and unlocking characteristics. This leads to wear and tear on the particular clasping device and to the attached article as well as to a malfunctioning of the basic locking mechanism.

A convenient, inexpensive and decorative clasping device for maintaining pair-integrity, while at the same time not interfering with the normal usage and processing of such paired articles is provided by the present invention. This device can be easily installed, can be made of a material which will resist wear and tear and can be fastened and unfastened using a uniform and simple manipulative procedure requiring little physical effort.

SUMMARY OF THE INVENTION

The separable fastening device of this invention comprises a pair of clasping members, formed of a rigid, bendable material, each member having a central aperture located therein to form a ring-like structure. A slot is formed in an edge section of each clasping member to split each edge section into two edge portions, the gap of said slot being less than the thickness of any of the members. An internal and external angular notch is also formed in each edge section of each member, the vertex of each angular notch terminating at the slot.

The clasping members are fastened by aligning the external notches of each edge section of each member in perpendicular relationship, rotating at least one of said clasping members about a radial axis common to each member toward a plane parallel with the other of said clasping members until the split end portions of each edge section of each member are flexed apart axially and oppositely at each slot sufficient to allow slideable movement of one of said members with respect to the other of said members. By sliding at least one of the members inwardly with respect to the other until the edge sections of each enter the central aperture of the other the device is fastened. When fastening occurs the split edge portions of each edge section return to their original unflexed position with the slot therebetween. The gap of each slot, being less than the thickness of each clasping member, prevents the fastened clasps from being unfastened. The clasps can be unfastened, however, by applying steps similar to the fastening steps but in reverse, that is aligning the internal notches of each edge section of each member in perpendicular relationship, rotating as described above to allow slideable movement of one of said members with respect to the other and sliding at least one of the members outwardly with respect to the other until the edge sections of each clear the edge sections of the other.

Each clasping member also has means for attaching each member to articles to be paired such as clothing articles.

DETAILED DESCRIPTION OF THE PREFERRED EMBODIMENTS

Figure 1:
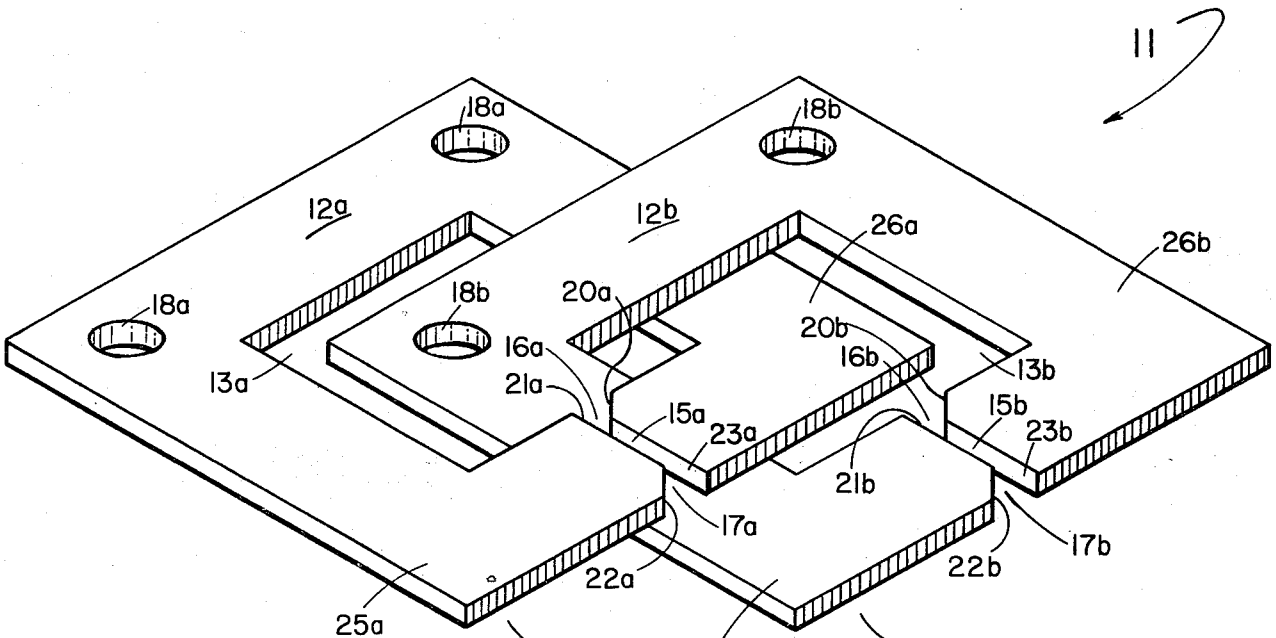
FIG. 1 is a perspective view of the spearable fastening device of this invention comprising two clasping members in the fastened condition.

FIG. 1 shows an embodiment of the separable fastening device of this invention indicated generally by 11 in the fastened condition comprising two identical clasping members shown generally by 12*a* and 12*b*. In the following description, elements of clasping member 12*a* will be designated by a reference numeral plus the letter a and elements of clasping member 12*b* identical to those of member 12*a* will be designated by the same reference numeral plus the letter b.

Each clasping member 12*a* or 12*b*, as shown in the Figures, has a substantially flat rectangular configuration with a central aperture, 13*a* & 13*b*, located therein to form two ring-like structures. Each clasping member is comprised of a rigid, bendable material such as metal, plastic, or the like.

One edge section, shown generally by 14*a* & 14*b*, of each clasping member has a slot, 15*a* & 15*b*, forming a linear gap in the respective edge sections thereby splitting each edge section into split edge portions 25*a* & 26*a* and 25*b* & 26*b*, the thickness of which gap is less than the thickness of each clasping member to prevent unintentional unfastening of the clasping device. Internal angular notches, shown generally by 16*a* & 16*b*, are formed in the inside edges of each edge section 14*a* & 14*b* and external angular notches, 17*a* & 17*b*, are formed in the outside edges of each edge section. Each internal angular notch is defined by oblique sides 20*a* & 20*b* and straight sides 21*a* & 21*b* on the opposite inner edges of the split edge portions. Each external angular notch is defined by oblique sides 22*a* & 22*b*, and straight sides 23*a* & 23*b*, on opposite outside edges of the split edge portions. The vertex of each external and internal angular notch terminates at the respective slots, 15*a* & 15*b* and, as shown, the angular notches are in an alternate exterior relationship.

Each clasping member 12*a* & 12*b*, is equipped with means for fastening the members to articles such as a pair of holes 18*a* & 18*b* located in the edge sections opposite to the edge sections containing slots 15*a* & 15*b* through which thread, wire loops or the like may be passed for securing to an article.

The clasping members shown in FIG. 1 are retained in their engaged condition by virtue of the fact that the width of the gap in slots 15*a* & 15*b* is less than the thickness of each clasping member, as previously mentioned, thus preventing the movement of any one member through the slot of any other member. For any one slot of one member to be widened to permit sliding therethrough of the other member would take inordinate finger strength and manual dexterity. For example, it would be required to flex the split end sections of the clasping member apart using considerable strength to widen the slot gap with two hands while simultaneously maneuvering the other clasping member into a position where it would be slid out the widened slot. The same problem exists if the clasping members were separated and it was desired to engage them from the unfastened condition.

Figure 2:
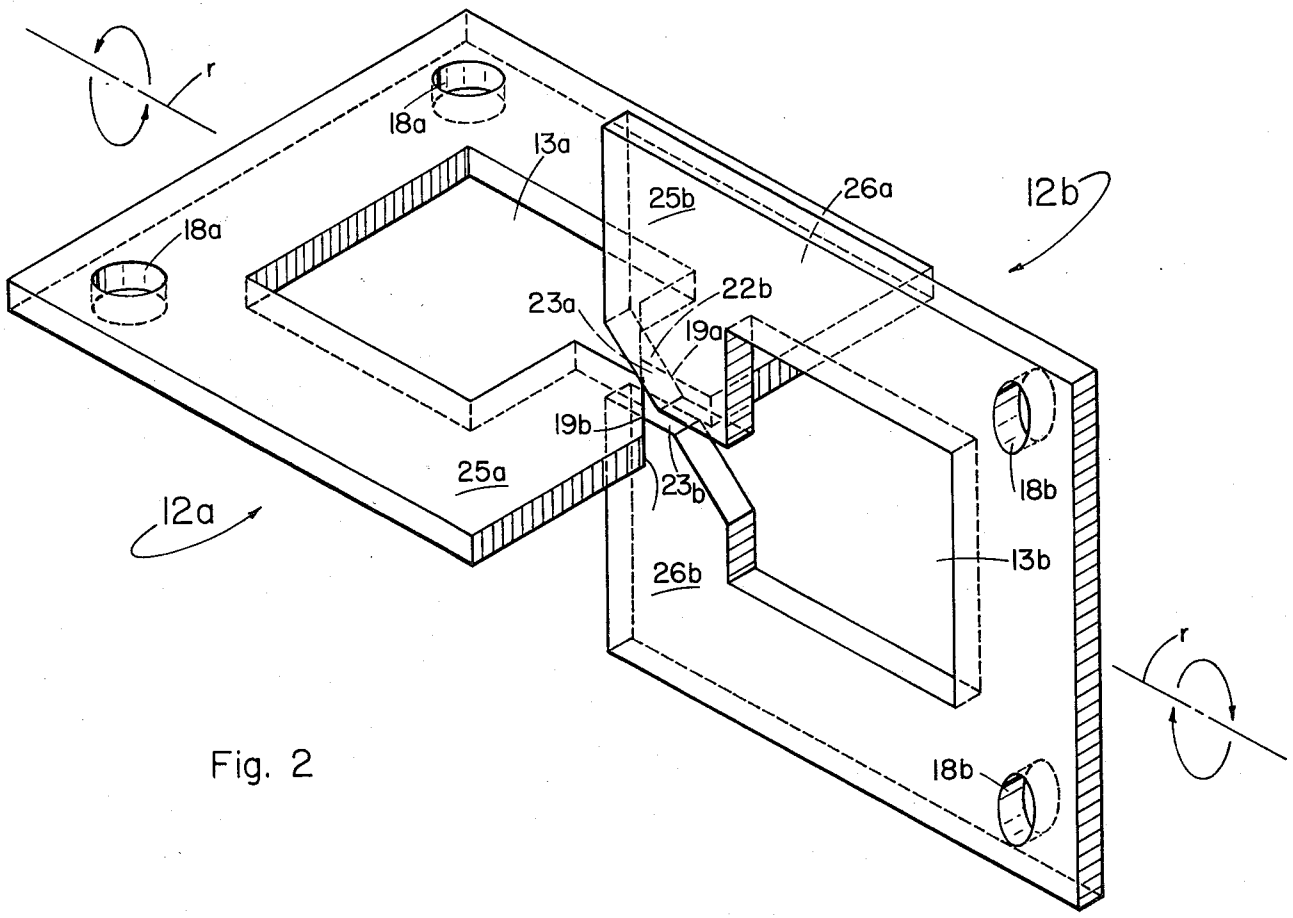
FIG. 2 shows the clasping members of FIG. 1 in the unfastened condition and in a position constituting the first step in bringing the members to the fastened condition.
Figure 3:
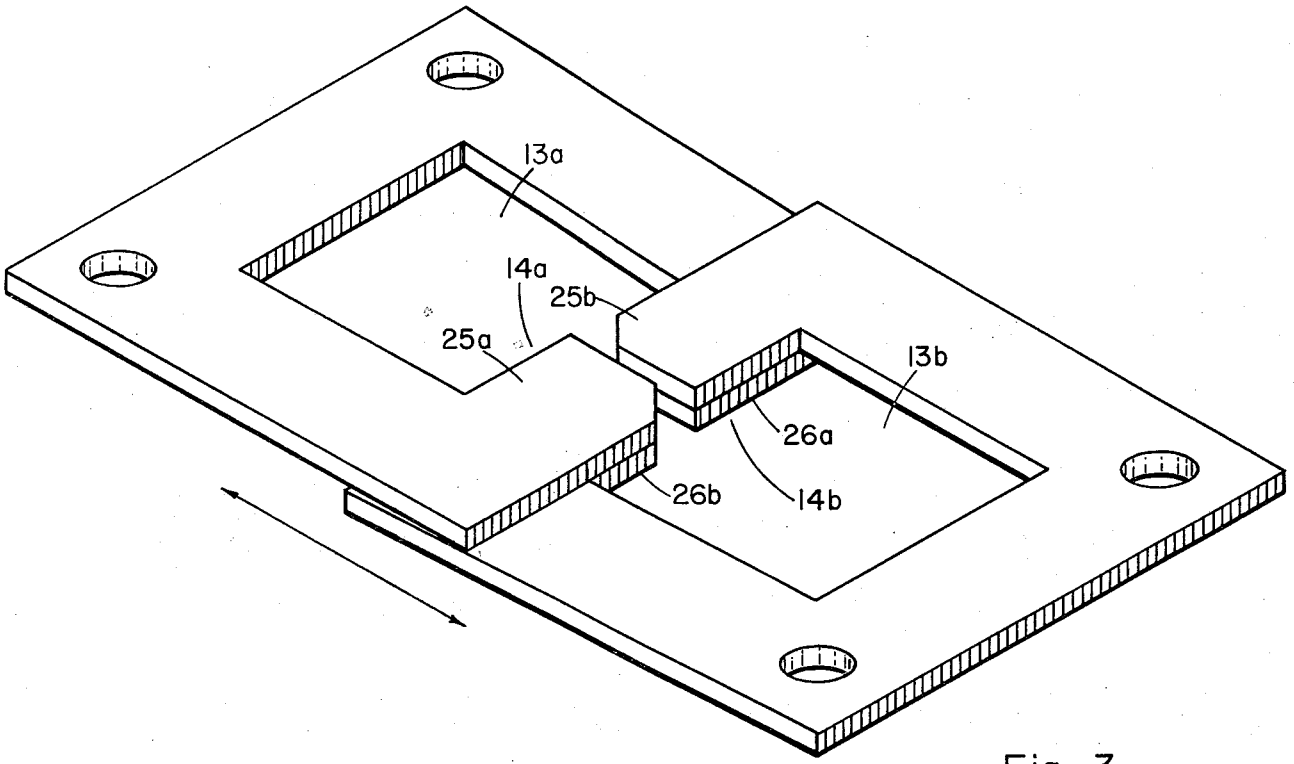
FIG. 3 shows the clasping members in a position constituting the second step in bringing the members to the fastened condition.
Figure 4:
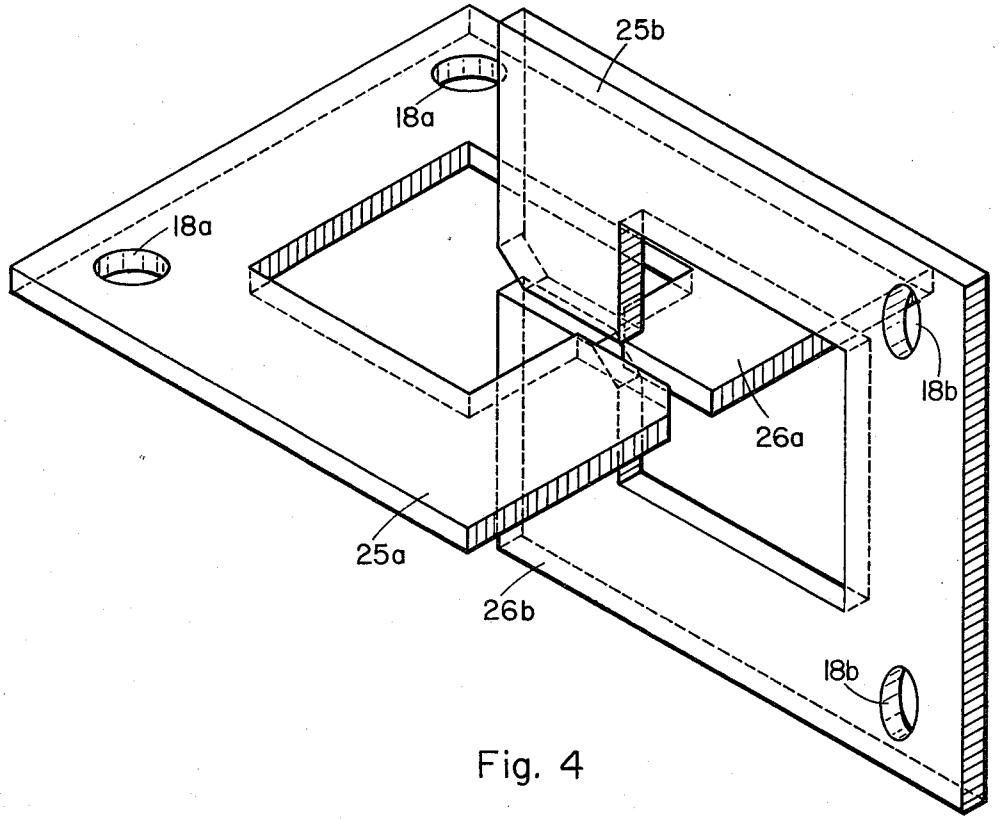
FIG. 4 shows the clasping members in a position constituting the third step in bringing the members to the fastened condition.

However, by virtue of the structure of each clasping member, particularly the provision of internal and external angular notches, the clasping members can be fastened or unfastened, rapidly and with little manual dexterity and strength as will be shown with reference to FIGS. 2, 3 and 4.

FIG. 2 shows the clasping members 12*a* & 12*b*, in the separated or unfastened condition preparatory to fastening, as shown in the Figure. Clasping member 12*b* is aligned perpendicular to clasping member 12*a* with the external angular notches, 17*a* & 17*b*, of each in mutual engagement. As shown, the oblique side 22*b* of member 12*b* faces downwardly. However, clasping member 12*b* can also be aligned perpendicularly to member 12*a* with oblique side 22*b* facing upwardly, that is with member 12*b* turned upside down. By virtue of such engagement, a pair of fulcrum points, 19*a* & 19*b* are created. Fulcrum point 19*a* is located at the intersection of one edge of oblique side 22*b* of the external angular notch of member 12*b* with the edge of straight side 23*a* of the external angular notch of clasping member 12*a*. Fulcrum point 19*b* is located at the intersection of the edge of oblique side 22*a* of the external angular notch 17*a* of member 12*a* with the edge of straight side 23*b* of the external angular notch 17*b* of clasping member 12*b*.

After the clasping members are aligned as shown in FIG. 2, clasping member 12*b* is rotated with respect to member 12*a* as shown by the arrows about common radial axis r to the condition shown in FIG. 3, i.e. mutually parallel planes. Alternatively, this condition can be accomplished by rotating clasping member 12*a* counter clockwise while member 12*b* is held stationary to a plane parallel with the plane of member 12*b* or member 12*a* and 12*b* can both be rotated in opposite directions about common axis r.

Such rotation causes the split end portions 25*a* and 26*a* of end section 14*a* of clasping member 12*a* to flex apart axially and oppositely as shown in FIG. 3. Similarly, the split end portions 25*b* and 26*b* of end section 14*b* of clasping member 12*b* are flexed apart axially and oppositely by the rotation. The relationship of the clasping members after such rotation is completed is that end portion 28*b* lies atop end portion 26*a*, end portion 25*a* lies atop end portion 26*b*, with portion 25*b* lying in the same upper plane as portions 25*a* and portion 26*a* lying in the same lower plane as portion 26*b*.

When the clasping members are substantially in the position shown in FIG. 3, a slight push of at least one member inwardly toward the central aperture of the other will cause the respective split end sections of each member to slidably move along their contacting surfaces with each end portion converging on the central apertures of the opposite member. After the internal angular notches of each clasping member align with each other, one or the other of the members are released and recoil back to a mutally perpendicular relationship about fulcrum points defined by the engagement of the internal notches as described in connection with FIG. 2 to a position as shown in FIG. 4. Thereafter a slight push will cause each edge section 14*a* & 14*b* to enter the central apertures 13*a* & 13*b* of opposite members as shown in FIG. 1 to fasten the device. To unfasten the device, the steps are repeated in reverse, that is the edge sections of the clasping members are moved perpendicularly to each other with their respective internal angular notches engaging, the members are rotated about fulcrum points defined by the intersection of edges of oblique sides of one internal angular notch with the edges of straight sides of the other internal angular notch to mutually parallel planes, one member is slid outwardly from the other until their external angular notches are aligned and then released to a perpendicular relationship after which a slight pull will completely disengage both members.

It is not necessary in fastening and unfastening the clasping members that the members be released to a mutually perpendicular relationship when their internal angular notches are aligned (during fastening) or when their external notches are aligned (during unfastening). Actually the clasping members can be released, in the case of fastening, after the edge sections 14*a* & 14*b* enter the central apertures, 13*a* & 13*b*, and in the case of unfastening after the edge sections are pulled clear of each other.

It is not required in this invention that the clasping members be rectangular in shape. They may each be of other geometrical shapes, e.g. circular or oval, and it is also not necessary that they be identical in shape. However, it is necessary that each clasping member have at least one substantially flat edge section which are each slotted and contain the internal and external angular notches as shown in connection with FIGS. 1 to 5 to allow fastening and unfastening of the members.

The separable fastening device of this invention has a myriad of uses including all the uses for which buttons, pins, clasps, studs, snaps, hooks or other clothing fastening devices have. The device is not limited to the fastening or attachment of clothing. It can be used for any fastening purpose which requires a secure closure and easy, rapid fastening and unfastening. In addition, because the fastening and unfastening of the device requires manipulation of the clasping members, the device can be used for applications where it is desired to make such fastening and unfastening "child proof."

I claim:

1. A separable fastening device comprising a pair of clasping members, each of said members being comprised of a rigid, bendable material having a central aperture extending therethrough and at least one substantially flat edge section, each flat edge section having:

(a) an internal angular notch;

(b) an external angular notch; and (c) a slot in said edge section connecting the vertexes of said internal and external angular notches and dividing each edge section into split edge portions, said slot forming a gap having a thickness less than the thickness of the edge section of said other of said clasping members; whereby said clasping members are connected by engaging the external angular notches of each of said edge sections; rotating at least one of said clasping members toward the other of said clasping members until the split end portions of each edge section are flexed apart axially and oppositely at each slot sufficient to allow lateral movement of one of said members with respect to the other of said members and moving the edge section of at least one of said clasping members inwardly with respect to said other member until said edge section of each of said clasping members enters the central aperture of said other member; and whereby said clasping members are disconnected by engaging the internal angular notches of each of said edge sections, rotating at least one of said clasping members toward the other of said clasping members until the said split end portions of each edge section are flexed apart axially and oppositely at said slots sufficient to allow lateral movement of one of said members with respect to the other of said members and moving the edge section of at least one of said clasping members outwardly with respect to the other of said members until the edge section of said one of said clasping members lies outwardly of said edge section of said other of said clasping members.

2. The separable fastening device of claim 1 wherein said pair of clasping members are duplicates.

3. The separable fastening device of claim 1 wherein each of said pair of clasping members is a flat, rectangular member and said central aperture is rectangular.

4. The separable fastening device of claim 1 wherein each of said pair of clasping members is comprised of metal.

5. A separable fastening device comprising a pair of clasping members, each of said members being comprised of a rigid, bendable material having a central aperture extending therethrough and at least one substantially flat edge section, each flat edge section having:

(a) an internal notch;

(b) an external notch; and (c) a slot in said edge section connecting said internal and external notches and dividing each edge section into split edge portions, said slot forming a gap having a thickness less than the thickness of the edge section of said other of said clasping members; whereby said clasping members are connected by engaging the external notches of each of said edge sections; rotating at least one of said clasping members toward the other of said clasping members until the split end portions of each edge section are flexed apart axially and oppositely at each slot sufficient to allow lateral movement of one of said members with respect to the other of said members and moving the edge section of at least one of said clasping members inwardly with respect to said other member until said edge section of each of said clasping members enters the central aperture of said other member; and whereby said clasping members are disconnected by engaging the internal notches of each of said edge sections, rotating at least one of said clasping members toward the other of said clasping members until the said split end portions of each edge section are flexed apart axially and oppositely at said slots sufficient to allow lateral movement of one of said members with respect to the other of said members and moving the edge section of at least one of said clasping members outwardly with respect to the other of said members until the edge section of said one of said clasping members lies outwardly of said edge section of said other of said clasping members.

* * * * *